US006007014A

United States Patent [19]

Krüger

[11] Patent Number: 6,007,014

[45] Date of Patent: Dec. 28, 1999

[54] WINDING MACHINE

[75] Inventor: Jens Krüger, Heidenheim, Germany

[73] Assignee: Voith Sulzer Papiermaschinen GmbH, Heidenheim, Germany

[21] Appl. No.: 09/064,699

[22] Filed: Apr. 22, 1998

[30] Foreign Application Priority Data

Apr. 22, 1997 [DE] Germany ..... 197 16 887

[51] Int. Cl.[6] ..... B65H 18/16; B65H 18/20; B65H 23/192; B65H 23/198

[52] U.S. Cl. ..... 242/418; 242/419.8; 242/530.1; 242/530.4; 242/541.1

[58] Field of Search ..... 242/418, 418.1, 242/419.5, 419.8, 419.9, 530.1, 530.3, 530.4, 541.1, 541.4, 541.5, 541.6, 541.7, 541, 542, 542.1, 542.3, 542.2

[56] References Cited

U.S. PATENT DOCUMENTS

| | | | |
|---|---|---|---|
| 2,399,155 | 4/1946 | Reed et al. | 242/530.1 |
| 3,157,371 | 11/1964 | Billingsley . | |
| 3,346,209 | 10/1967 | Cronin . | |
| 3,405,855 | 10/1968 | Daly . | |
| 3,433,398 | 3/1969 | Fadden et al. | 242/419.8 |
| 3,685,711 | 8/1972 | Gay | 242/530.1 |
| 3,735,937 | 5/1973 | Plantard | 242/530.1 |
| 3,853,282 | 12/1974 | Wentworth | 242/419.8 |
| 4,496,112 | 1/1985 | Olsson . | |
| 5,308,006 | 5/1994 | Hehner . | |
| 5,405,099 | 4/1995 | Hehner et al. | 242/541.1 |
| 5,437,417 | 8/1995 | Kammann | 242/541.1 |

FOREIGN PATENT DOCUMENTS

| | | |
|---|---|---|
| 704163 | 3/1941 | Germany . |
| 1229361 | 11/1966 | Germany . |
| 1274853 | 8/1968 | Germany . |
| 2429530 | 1/1975 | Germany . |
| 2507484 | 9/1976 | Germany . |
| 3514042A1 | 10/1986 | Germany . |
| 3644511A1 | 7/1988 | Germany . |
| 3636457C2 | 9/1989 | Germany . |
| 3832601C2 | 12/1989 | Germany . |
| 4102374A1 | 8/1992 | Germany . |
| 4115888A1 | 10/1992 | Germany . |
| 9116467 U | 12/1992 | Germany . |
| 4123761A1 | 1/1993 | Germany . |
| 4012979C2 | 3/1993 | Germany . |
| 4134648A1 | 4/1993 | Germany . |
| 19540748 | 5/1996 | Germany . |
| 19636894 | 9/1996 | Germany . |
| WO 95/32908 | 12/1995 | WIPO . |

*Primary Examiner*—John M. Jillions
*Attorney, Agent, or Firm*—Townsend and Townsend and Crew LLP

[57] ABSTRACT

In a winding machine for the production of at least one coil (10) of a supplied material web, such as in particular a paper web and/or a card web, the material web (12) is guided through a longitudinal cutting device (16) and the partial webs of the longitudinally cut material web (12) are each wound up onto a core (18), in particular a core (18) formed by a sleeve. A coil (10) arising on the core (18) is supported by at least one support roll (20), in particular a drivable support roll, and the hardness of the winding can be influenced by a web tension interruption device (22). The web tension interruption device (22) is provided in the running direction of the web directly in front of a position (S) where the supplied material web (12) or its partial webs run onto an associated support roll (20), and is also arranged between the longitudinal cutting device (16) and the run-on position (S). It includes at least one roll (24) spatially separate from the associated support roll (20). The at least one roll spatially separate from the relevant support roll (20) can be driven. The web tension interruption device (22) is subdivided transversely to the web running direction (L), and at least one segment is associated with each partial web of a longitudinally cut material web (12). The tensions of the various partial webs can be controlled independently from one another via the segments or segment groups associated therewith.

18 Claims, 3 Drawing Sheets

WINDING MACHINE

FIELD OF THE INVENTION

The invention relates to a winding machine for the production of at least one coil of a supplied material web, such as in particular a paper web and/or a card web, wherein the material web is guided through a longitudinal cutting device and the partial webs of the longitudinally cut material web are each wound up onto a core, in particular a core formed by a sleeve, wherein a coil arising on the respective core is supportcd on at least one support roll, in particular a drivable support roll, and the hardness of the winding can be influenced by a web tension interruption device, and wherein the web tension interruption device is provided, in the direction of running of the web directly in front of a position at which the supplied material web or its partial webs run onto a respective support roll, and is also arranged between the longitudinal cutting device and the run-on position, and includes at least one roll spatially separate from the relevant support roll.

DESCRIPTION OF PRIOR ART

A winding machine of this kind is, for example, known from DE-U-91 16 467.

In most of the previously customary winding machines the web tension interruption device is a free-running roll, which can be pressed against a drivable support roll, onto which the material web, which has previously been guided through a longitudinal cutting device, runs. A winding machine of this kind is, for example, known from DE 40 12 979 C2.

With a web tension interruption device of this kind, the possibility is admittedly provided through active elements, such as for example a center drive in a paper reel and a brake generator for the unrolling of the web, of producing different longitudinal tensions in the material web for the longitudinal cutting and for the coiling. In this way it is possible, on the one hand, to influence the winding hardness in the wound reel which arises, and, on the other hand, care can be taken to ensure a specific longitudinal tension during longitudinal cutting independently of the winding hardness. In modern paper manufacturing or processing plants the requirement, however, now frequently exists to increase the winding hardness in the wound reel which arises considerably beyond the previously customary level. This requirement can only be inadequately satisfied with the known winding machine. This can be attributed, on the one hand, to the fact that limits are placed on the supply of drive energy both in the driving of the wound reel which arises through a support roll or loading device, which acts at its periphery, i.e. during the production of a speed difference or peripheral force difference between at least two peripheral drives, and also during the driving of the winding reel by a driven core.

A winding machine of the initially named kind is already known from DE-U-91 16 467, in which the wcb tension interruption device is provided, in the running direction of the web, directly in front of the position where the material web which is supplied, or its partial webs, run onto a respective support roll, and includes at least one roll spatially separate from the relevant support roll. The roll which has the width of the machine is pressed against a guide roll, which likewise extends over the entire machine width in order to slow down the partial webs. In this arrangement the roll, which is subdivided into individual segments and rubberized at its surface, is pressed by means of a piston/cylinder unit against the freely rotatable guide roll, around which the partial webs are wrapped. The segments of the roll are jointly slowed down by means of a common brake associated with them, such as for example a common friction brake with an adjustable braking force. Since the web tension interruption device is only formed as a braking device, and since the different partial webs must always be jointly influenced in the same manner via the brake, a variable adjustment of the individual web tensions of the different partial webs which is desirable in certain cases is not straightforwardly possible.

OBJECT OF THE INVENTION

It is an object of the invention to provide a winding machine of the initially named kind which permits, with minimal cost and complexity, not only the setting of higher winding hardnesses in a respectively arising coil without problem, but which rather simultaneously also ensures a higher variability with respect to a separate influencing of the tensions of the various partial webs.

BRIEF DBSCRIPTION OF THE INVENTION

This object is satisfied in accordance with the invention in that the at least one roll spatially separate from the relevant support roll can be driven, and in that the web tension interruption device is subdivided transversely to the web running direction and in that at least one segment is associated with each partial web of a longitudinally cut material web, with the tensions of the various partial webs being capable of being influenced independently from one another via the segments or segment groups associated therewith. The at least one roll spatially separate from the relevant support roll is preferably drivable independently of the support roll, The web tension interruption device is thus not only provided separately from the support roll, onto which the supplied longitudinally cut material web runs, but rather it is also arranged at a certain, preferably relatively short distance from the run-in point. It is in particular also drivable and so segmented that it is possible to separately influence the tensions of the different partial webs via the segments or segment groups. In this way the possibility for a further optimization of the respective operating conditions is in particular also provided. In this way one obtains in total substantially more freedom, both with respect to a setting of the longitudinal tension of the material web in the region of the longitudinal cutting device independently of the longitudinal tension of the material web in the run-in region, and also with respect to a separate influencing of the tensions of the different partial webs. Since a substantially higher web tension can be set in the running direction of the web after the web tension interruption device than in the region of the longitudinal cutting device, the danger of tearing of the material web in the region of this longitudinal cutting device is reduced to a minimum. However, at the same time, the possibility exists of supplying the material web under a very high web tension to the arising coil, so that a very high winding hardness can in particular also be set. This is in principle possible without a further drive at the respectively arising coil. Depending on the requirements, at least one coil which is to be formed can, however, additionally be driven, in particular with a relatively low power, which is, for example, of advantage when at least two mutually displaced coils are formed and different winding hardnesses are optionally desired.

With an active element which is different in comparison to the relevant elements of the winding machine known from DE 40 12 979 C2, it is possible to influence the winding hardness through the production of the speed difference between the rolling up and the web tension interruption device (extension of paper).

The invention is fundamentally also usable in a rewinder, that is to say in a plant without a longitudinal cutting device but with winding up onto a, for example, sleeve-like core.

The material web to be wound up can, for example, come from an unrolling station or directly from a web manufacturing machine, such as for example a paper-making machine.

In certain cases it is of advantage if the core, for example the sleeve-like core, onto which the material web is wound, can be driven. It is of especial advantage in this respect if at least once coil is produced on a sleeve forming the associated core and if the relevant device for the introduction of a torque into this coil includes at least one drivable guide head which engages into a sleeve end. Two guide heads which engage into the two opposite sleeve ends can be provided, with both guide heads preferably being drivable.

Thus, the respective additional drive can also be provided as a center drive, which is for example executed in the manner which is described in DE 40 12 979.

The connection between a respective guide head and the sleeve can, for example, take place by means of a clamping head in the manner described in DE 36 36 457 C2.

Additionally or alternatively at least one arising coil can be acted on by at least one drivable loading device, preferably a loading roll, in order to introduce a torque into the coil through this loading device. In this respect the coil can be pressed by the loading device against one or more support rolls. In an embodiment preferred in practice the loading device is drivable independently of the support roll. The winding hardness and/or the web tension can thus be increased through the production of a peripheral force difference between a plurality of peripheral drives.

It is of particular advantage when the drive torques of different arising coils can be controlled and/or regulated independently from one another.

The web tension interruption device can, for example, include a roll pair which consists in particular of a preferably segmented guide roll and a preferably segmented clamping roll.

In accordance with a further advantageous variant, the web tension interruption device includes a set of a plurality of guide roller, preferably partly segmented guide rolls, around each of which the material web is wrapped, with the wrapping angle preferably being greater than 45° in each case. The wrapping angle can expediently also be greater than or equal to 90° at at least one of the guide rolls. In this respect the web tension interruption device can, for example, be formed by a set of three guide rolls around which the web is extensively wrapped, as is described in U.S. Pat. No. 157,371.

In a further advantageous variant, the web tension interruption device is formed by a single, expediently segmented guide roll, around which the material web is wrapped, with the wrapping angle expediently being greater than 45°, and preferably being greater than or equal to 90°.

BRIEF DESCRIPTION OF THE DRAWINGS

The invention will be explained in more detail in the following with embodiments and to the drawings, in which are shown.

DESCRIPTION OF PREFERRED EMBODIMENTS

Figure 1:
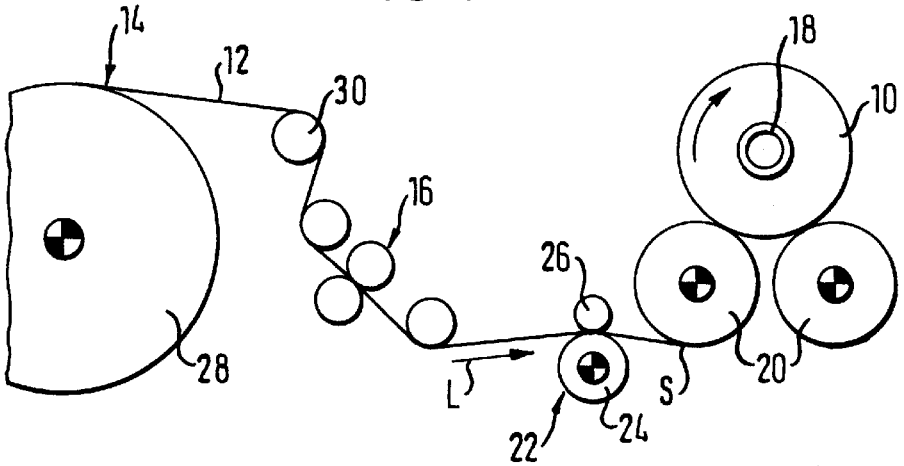
FIG. 1 is a schematic side view of an embodiment of a winding machine in the form of a double support roll machine with a single winding bed for one or more coils that are to be produced.

FIGS. 1 to 6 show different embodiments of a winding machine for the production of at least one coil 10 and preferably a plurality of coils 10 from a supplied material web 12, such as in particular a paper web and/or a card web, which comes for example from an unrolling station 14 (see FIG. 1), or directly from a web manufacturing machine, such as for example a paper-making machine.

In this connection a longitudinal cutting device 16 is provided in each case, through which the material web 12 is guided prior to winding it up in order to form a plurality of partial webs. These partial webs are each wound onto a core which is formed in the present case by a sleeve 18. In this connection a coil 10 which arises on the respective sleeve 18 is supported on at least one drivable support roll 20.

Moreover, in all the embodiments shown in FIGS. 1 to 6, the winding hardness can be influenced by a respective, preferably segmented web tension interruption device 22, which is provided, as seen in the web running direction L, directly in front of a position S, at which the supplied material web 12 or its partial webs run onto a respective support roll 20, and by at least one roll 24, preferably a segmented roll, which is spatially separate from the relevant support roll 20 and preferably drivable independently of the support roll 20.

As can be seen from FIGS. 1 to 6, the web tension interruption device 22 is in each case arranged, in the direction of web running L, between the longitudinal cutting device 16 and the relevant run-in position S.

The sleeve 18, onto which the material web 12 or a respective partial web is wound, is in each case drivable.

In addition, or alternatively to this central drive, an arising coil 10 can also be loaded by a drivable loading device, such as for example a loading roll, through which a torque can be introduced into the coil 10. In this arrangement the relevant coil 10 can be pressed by such a loading device against one or more support rolls 20.

The drive torques of differently arising coils 10 are preferably controllable and/or regulatable independently from one another.

Moreover, the web tension interruption device 22 is preferably subdivided into segments transverse to the web running direction L, with at least one segment being associated with each partial web of the longitudinally cut material web 12. In this case the segments or segment groups associated with the different partial webs are preferably drivable independently from one another.

FIG. 1 shows an embodiment of a winding machine in the form of a double support roll machine with a single winding bed for one and preferably several coils 10 that are to be produced. The two support rolls 20 which can be recognized in FIG. 1 serve here as support rolls, on which the respective coil 10 lies, The web tension interruption device 22 of this embodiment includes a roll pair, which comprises a driven guide roll 24 and a clamping roll 26. The driven guide roll 24 and/or the clamping roll 26 is/are preferably segmented transverse to the web running direction L.

In the unrolling station 14 the material web 12 is drawn off from a drivable roll 28. Following this, the drawn off material web 12 is first guided around at least one guide roll 30 before it is supplied to the longitudinal cutting device 16.

The driving positions are each individually controllable and/or regulatable.

Figure 2:
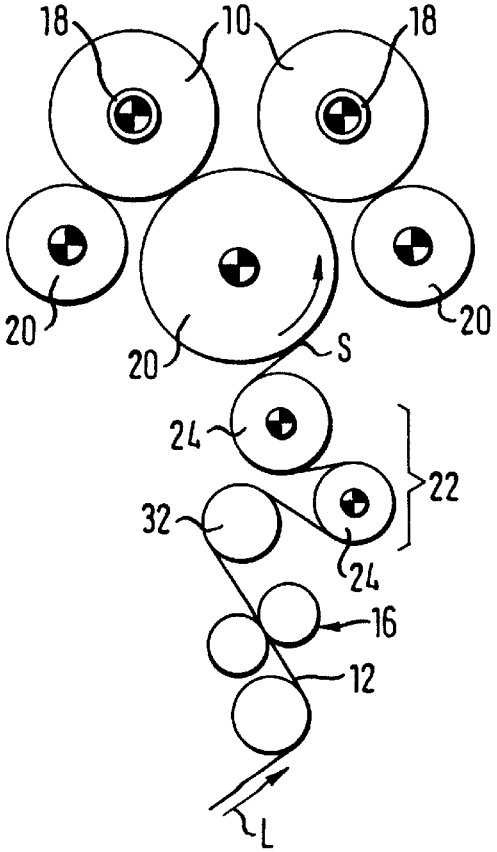
FIG. 2 is a schematic side view of a further embodiment of a winding machine in the form of a three support roll machine with two winding beds for at least two coils which arise displaced from one another.

FIG. 2 shows an embodiment in the form of a three-support roll machine with two winding beds for at least two coils 10 which arise displaced relative to one another.

As can be recognized with respect to FIG. 2 each coil 10 lies at one side on a central support roll 20 and at the other side on a respective outer support roll 20, with a respective winding bed being formed between the two relevant, adjacently disposed support rolls 20.

The web tension interruption device 22 includes, for example, two driven guide rolls 24, of which at least one is preferably segmented and also a further, non-driven guide roll 32. For all guide rolls 24, 32, the respective wrapping angle, i.e. the angle over which the web is wrapped around the associated roll, is significantly greater than 45°. As can be recognized with respect to FIG. 2, this wrapping angle at the central driven guide roll 24 is significantly greater than 90°. In the present embodiment, the wrapping angle lies between 90 and 180° for both the non-driven guide roll 32 lying in front of the central guide roll in the web running direction L, and also for the rear driven guide roll 24. Other wrapping angles are, however, fundamentally also possible.

Figure 3:
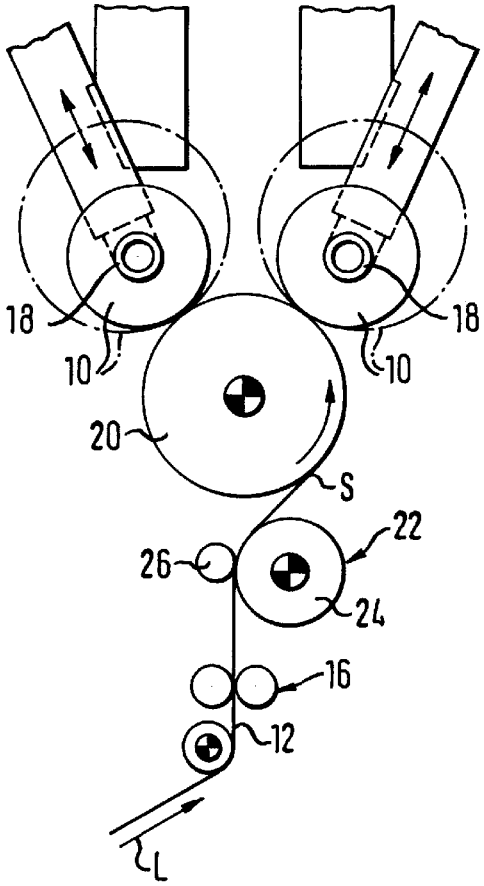
FIG. 3 is a schematic side view of a further embodiment of a winding machine in the form of a mono-support roll machine, preferably for at least two coils which arise displaced from one another.

FIG. 3 shows an embodiment in the form of a mono-support roll machine for at least two coils 10 which arise displaced relative to one another.

In this embodiment only one support roll 20 is provided, on which the arising coils 10 lie or against which these coils 10 are pressed.

The web tension interruption device 22 again includes, as in the case of the embodiment of FIG. 1, a roll pair which consists of a driven, preferably segmented guide roll 24 and a preferably segmented clamping roll 26.

Figure 4:
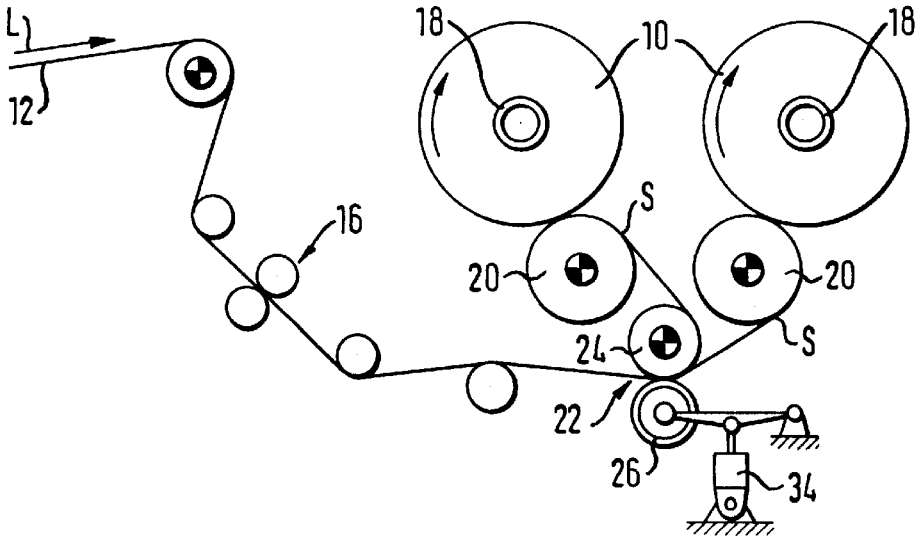
FIG. 4 is a schematic side view of a further embodiment of a winding machine in the form of a double mono-support roll machine for at least two coils which arise displaced from one another.

FIG. 4 shows an embodiment in the form of a double mono-support roll machine for at least two coils 10 which arise displaced relative to one another.

Two support rolls arranged displaced relative to one another can be seen in FIG. 4. A partial web of the longitudinally cut material web 12 runs onto each of these support rolls, each of which supports a respective coil 10.

The web tension interruption device 22 of this embodiment again includes, in the same way as the embodiments of FIGS. 1 and 3, a roll pair which consists of a driven, preferably segmented guide roll 24 and a preferably segmented clamping roll 26. In accordance with FIG. 4 the clamping roll 26 is pressed by a pressing device 34 against the driven guide roll 24. A corresponding pressing device 34 is expediently also provided at the embodiments illustrated in the FIGS. 1 and 3.

Figure 5:
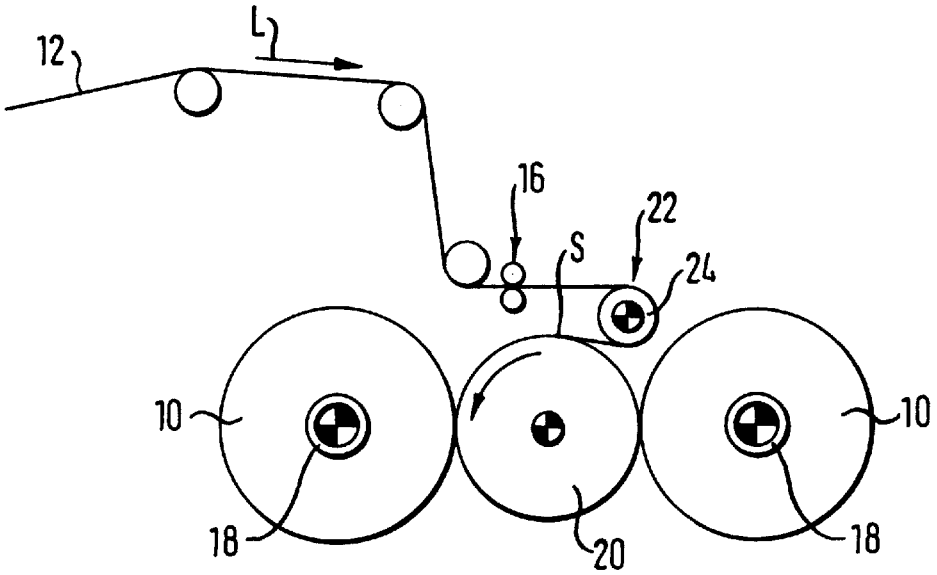
FIG. 5 is a schematic side view of a further embodiment of a winding machine similar to that of FIG. 3 in which the web tension interruption device is formed by a single, individually drivable and preferably segmented guide roll around which the web is extensively wrapped.

FIG. 5 shows an embodiment of a winding machine similar to FIG. 3, in which the web tension interruption device 22 is, however, formed by a single, individually drivable and preferably segmented guide roll 24, around which the web 12 is extensively wrapped over a considerable angle. The wrapping angle amounts in this case to about 180°.

Figure 6:
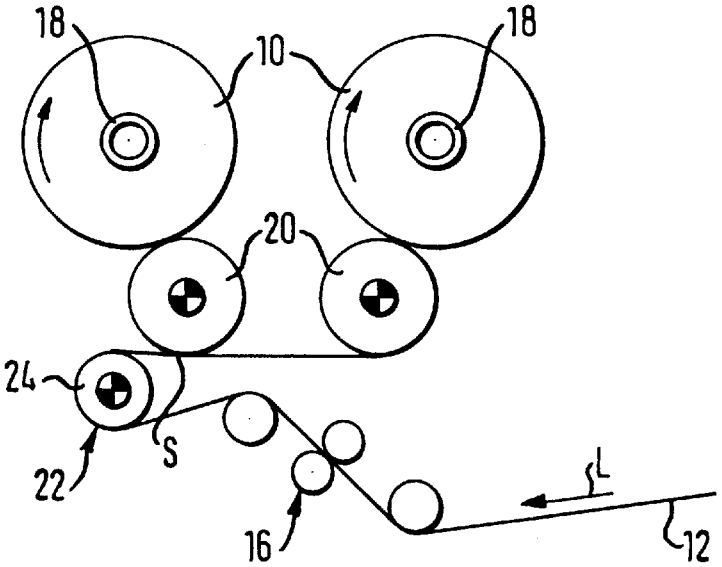
FIG. 6 is a schematic side view of a further embodiment of a winding machine similar to that of FIG. 4, in which the web tension interruption device is formed by a single, individually drivable and preferably segmented guide roll, around which the web is extensively wrapped.

The two coils 10 which can be recognized in FIG. 5 are arranged at mutually opposite sides of a central support roll 20, FIG. 6 shows an embodiment of a winding machine similar to FIG. 4, in which the web tension interruption device 22 is, however, formed by a single, individually drivable and preferably segmented guide roll 24, around which the web 12 is extensively wrapped over a considerable angle. In this case the wrapping angle is greater than 180°.

The various segments and/or segment groups of a respectively driven segmented roll can be separately driven in all embodiments and/or the different segments and/or segment groups of a respective clamping roll can be subjected to separate pressing, i.e. pressed separately against the web 12 supported on the associated guide roll 24.

Figure 7:
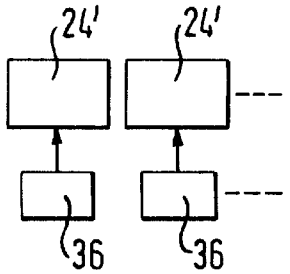
FIG. 7 is a purely schematic partial illustration of a roll of a web tension interruption device which is segmented transversely to the web running direction and provided with individual drives.

FIG. 7 shows, by way of example in a purely schematic partial illustration, a drivable roll 24 of a web tension interruption device segmented transverse to the web running direction and provided with individual drives 36, in which the different roll segments 24' can be driven independently from one another via the individual drives 36.

What is claimed is:

1. Winding machine for the production of at least one coil of a supplied material web, wherein the material web is guided through a longitudinal cutting device and partial webs of the longitudinally cut material web are each wound onto a core, wherein coils arising on the respective cores are each supported by at least one drivable support roll and the hardness of the winding of the coil can be controlled by a web tension interruption device positioned, in a running direction of the web, directly in front of a run-on position whereby the supplied partial webs run onto an associated support roll and between the longitudinal cutting device and the run-on position the tension interruption device including at least one roll that is spatially separate from the associated support roll, characterized in that the at least one roll spatially separate from the associated support roll is a driven roll, in that the web tension interruption device is subdivided transversely to running direction of the web and has at least one segment associated with each partial web of the longitudinally cut material web, the tensions of the partial webs being independently controllable from one another via the segments associated with the partial webs.

2. Winding machine in accordance with claim 1, characterized in that the segments of the web tension interruption device associated with the different partial webs are driven independently from one another.

3. Winding machine in accordance with claim 1, characterized in that the at least one roll that is spatially separate from the associated support roll is driven independently from the support roll.

4. Winding machine in accordance with claim 1, characterized in that a device is provided for introducing a torque into at least one arising coil.

5. Winding machine in accordance with claim 4, characterized in that the device for introducing a torque comprises means for subjecting at least one coil arising from a partial web of the longitudinally cut material web to the torque.

6. Winding machine in accordance with claim 4, characterized in that the core onto which a respective partial web is is driven.

7. Winding machine in accordance with claim 6, characterized in that at least one core on which a partial web is wound comprises a sleeve, and in that the device for introducing a torque into coil wound onto the at least one core includes at least one drivable guide head engaging an end of the sleeve.

8. Winding machine in accordance with claim 7, characterized in that two drivable guide heads are provided which engage opposite ends of the sleeve.

9. Winding machine in accordance with claim 1, characterized by at least one drivable loading roll for introducing a torque into at least one arising coil.

10. Winding machine in accordance with claim 9, characterized in that the loading roll presses the at least one arising coil against at least one support roll.

11. Winding machine in accordance with claim 9, characterized in that the loading roll is driven independently from the support roll.

12. Winding machine in accordance with claim 1, characterized in that the drive torques of different arising coils are controlled and/or regulated independently from one another.

13. Winding machine in accordance with claim 1, characterized in that the web tension interruption device includes a roll pair which comprises a segmented guide roll and a segmented clamping roll.

14. Winding machine in accordance with claim 1, characterized in that the web tension interruption device includes a set of a plurality of guide rolls about each of which the material web extends over a wrapping angle greater than 45°.

15. Winding machine in accordance with claim 14, characterized in that the wrapping angle for at least one of the guide rolls is at least 90°.

16. Winding machine in accordance with claim 1, characterized in that the web tension interruption device is formed by a single segmented guide roll about which the material web extends over a wrapping angle greater than 45°.

17. Winding machine according to claim 16 wherein the wrapping angle is at least 90°.

18. Winding machine for producing at least one coil of a supplied material web comprising a cutting device for longitudinally cutting a supplied material web into a plurality of partial webs; a core for winding each partial web into a coil; a support roll for supporting each partial web coil wound about a core; and a tensioning device located upstream of the support roll and downstream of the cutting device, the tensioning device including at least one driven roll that is spaced from the associated support roll and is subdivided in a direction transverse to a running direction of the web into a plurality of segments, at least one segment being provided for each partial web, and a controller operatively coupled with the segments for independently controlling the tension in the partial webs with the associated segments.

* * * * *